US006712050B1

(12) United States Patent
Gomez

(10) Patent No.: US 6,712,050 B1
(45) Date of Patent: Mar. 30, 2004

(54) APPARATUS FOR IMPROVING COMBUSTION EFFICIENCY IN INTERNAL COMBUSTION SYSTEMS

(76) Inventor: Luis Gomez, 318 Arizona St., Hollywood, FL (US) 33019

( * ) Notice: Subject to any disclaimer, the term of this patent is extended or adjusted under 35 U.S.C. 154(b) by 0 days.

(21) Appl. No.: 10/286,970

(22) Filed: Nov. 4, 2002

(51) Int. Cl.[7] ..... F02M 27/04
(52) U.S. Cl. ..... 123/536; 123/538
(58) Field of Search ..... 123/536, 537, 123/538

(56) References Cited

U.S. PATENT DOCUMENTS

| | | | | |
|---|---|---|---|---|
| 4,429,665 A | | 2/1984 | Brown | |
| 4,930,483 A | | 6/1990 | Jones | |
| 4,959,155 A | * | 9/1990 | Gomez | 123/538 |
| 5,013,450 A | * | 5/1991 | Gomez | 123/538 |
| 5,447,625 A | * | 9/1995 | Roe | 123/538 |
| 5,524,594 A | * | 6/1996 | D'Alessandro | 123/538 |
| 6,306,185 B1 | | 10/2001 | Berlin et al. | |

* cited by examiner

*Primary Examiner*—Marguerite McMahon
(74) *Attorney, Agent, or Firm*—Browdy and Neimark, P.L.L.C.

(57) ABSTRACT

This invention relates to an apparatus for improving combustion efficiency in internal combustion systems, comprising a casing having an inlet and an outlet at its ends for receiving and discharging, respectively, the fuel to be treated; an elongated metal bar concentrically located within said casing between said inlet and said outlet so as to enter into direct contact with the fuel, said metal bar being made of an alloy comprising, by weight, 30–60% cooper, 10–30% nickel, 15–40% zinc, 5–20% tin and 1–10% silver; a sleeve concentrically located between said casing and said elongated metal bar; separation means concentrically situated between said casing and said sleeve, to isolate said casing from said sleeve; interconnecting means attached to said inlet and said outlet, to interconnect the apparatus with the fuel supply and the internal combustion system; fixing means situated inside of each end of the casing, to hold the metal bar in place; grounding means located at the outer surface of the casing, to ground the apparatus when in use, to thus protect the reaction of the fuel and the metal bar from any interference caused by magnetic fields generated by any electric supply source; and, a plastic film externally covering each end of said casing for electrically insulating said ends.

14 Claims, 3 Drawing Sheets

APPARATUS FOR IMPROVING COMBUSTION EFFICIENCY IN INTERNAL COMBUSTION SYSTEMS

TECHNICAL FIELD

This invention relates to the techniques used to improve the performance of internal combustion systems in order to reduce emission of contaminants and economize the use of fuel, and more specifically, relates to an apparatus for improving combustion efficiency in internal combustion systems.

BACKGROUND OF THE INVENTION

It is well known that combustion engines are thermal machines. They are also called explosion engines, as combustion in the cylinder occurs extremely quickly and within the engine itself, not in an independent chamber.

During combustion, chemical energy is converted into kinetic energy that, in turn, is converted into mechanical energy, using a special mechanism, which may be used for specific actions.

Internal combustion engines use the expansion of gases produced by the live combustion of a carburet ant mixture in the combustion chamber of the cylinders, so that the gases drive a piston, the movement of which, through a connecting rod, causes the crankshaft to rotate.

They may function at either a four- or two-stroke cycle. In the first case, the cycle sequence is as follows: intake, when the piston, driven by the crankshaft, drops and draws in the carburet ant mixture from the carburetor into the cylinder; compression, the crankshaft forces the piston up and the piston strongly compresses the carburet ant mixture in the combustion chamber; explosion, the spark that passes between the spark plug's electrodes ignites the mixture, thus causing the combustion gases to expand violently and drive the piston, producing work and pulling the crankshaft; and, exhaust, the piston rises again and forces out the combustion gases. The opening of intake and exhaust valves and the creation of the spark in the combustion chamber are occasioned by the synchronized movement of the crankshaft.

On the other hand, in two-stroke engines, the four phases of the cycle take place in one single in-and-out movement of the piston, without the need for valves; these are replaced by ports that are conveniently fixed to the cylinder wall.

There are also diesel engines that are a variant on internal combustion engines, as they have not an ignition system or a carburetor. In these engines, when the piston drops, clean air is sucked in and when the piston rises, it powerfully compresses the air and heats it to a very high temperature to then inject a jet of liquid fuel that is pulverized in the chamber and, due to the effect of the temperature in the chamber, is spontaneously ignited (explosion), thus producing the gases that drive the piston.

The most common forms of combustion are those of carbon and hydrogen compounds in the presence of air, and for combustion to be complete, the air drawn in must have sufficient oxygen to convert all the carbon into carbonic gas and all the hydrogen into water.

On the other hand, it should be mentioned that one of the human race's greatest concerns in modern times is the serious deterioration of the environment as, day after day, an endless number of contaminants are emitted into the atmosphere in the form of gases or solid particles. As they cannot be processed or eliminated by natural reaction mechanisms, gases remain mixed in the air and particles remain in suspension, causing serious, in some cases, irreversible damage to the human respiratory system.

Some of the main producers of contaminants include industry, that requires oil-based fuel to run its production lines, and motor vehicles, particularly in third-world and developing countries, where the majority of vehicles are old and are not fitted with anti-pollution devices, on account of which all combustion gases are emitted into he atmosphere.

The motor vehicle problem is accentuated in cities with major traffic congestion problems, such as Mexico City where the roads resemble a parking lot, particularly during the rush hour. Vehicles that are virtually stationary with the engine running emit a large amount of contaminants into the atmosphere.

The subject of energy has been discussed for many years in both national and international circles, particularly in the oil, oil derivatives and oil-based fuel industries, because, as we are all well aware, oil is a limited natural resource.

As combustion is also a key factor in the generation of power, large sums of money and much effort have been spent on researching and seeking a more efficient means of burning fuel. Likewise, researchers are striving to reduce the level of contaminants released during combustion as they have a detrimental effect on the environment, such as producing acid rain.

It is for this reason that for many years, various devices have been developed to not only optimizes the combustion process, mainly in internal combustion engines, but also to reduce contaminants and save fuel. Nevertheless, they have only gone part of the way towards fulfilling the purpose for which they were designed and built.

The majority of the equipment and devices developed use magnetic media that generate a magnetic field to align the hydrocarbon chain, and thus make the combustion process more complete.

One of these devices is outlined in Mexican Patent No. 173141, whose inventor also invented this particular apparatus. It relates to a method and a solid material body to purify liquids, such as water, aqueous liquids and liquid fuels. These pass through a hollow chamber that has an inner body of solid material made from an alloy of 50 to 60 weight % copper, 0.5 to 8 weight % nickel, 20 to 28 weight % zinc, 1.3 to 4.5 weight % tin, 0.005 to 2 weight % aluminum and 7 to 15 weight % manganese. The alloy purifies the water or aqueous liquid and reduces hardness of the water, thus preventing the formation of scale, rust and corrosion that damage the pipes through which they pass, or the receptacles in which they are stored.

Mexican Patent No. 171087 relates to a fuel treatment unit for internal combustion engines. It has a container with an intake and an outlet, a metal element made from aluminum fixed to the container, and an additional metal element made from an alloy of aluminum, copper, tin, zinc, iron, nickel, lead, sulfur and phosphorus in the middle of the container; these two elements combine to form a non-linear flow path. The lead, sulfur and phosphorous of the additional metal element are in the form of residual traces so their presence is irrelevant.

Mexican Patent No. 197033 describes a fuel economizing unit and a contaminant reducer to be used in internal combustion engines or industrial or domestic ovens. This invention's specific characteristic is a cartridge made up of an outer copper cylinder with two metal ends (the cartridge is both the fuel container and conductor). At each of the metal ends of the outer cylinder is a nozzle in the form of a spigot with a screw thread, through which the fuel that passes through the unit flows in and out; these also function as fuel conductors. Inside the cartridge is an alloy in the form of metal granules that is held in place by non-corroding bars. These metal granules are made up of 56 to 58% copper, 17 to 19% zinc, 13 to 15% nickel, 2 to 4% tin, 1 to 3% silver and 5 to 7% lead and their function is to fracture and align the hydrocarbon chain. The cartridge also has an inner copper casing, surrounded by the metal granules, that includes one or several isotropic barium ferrite nuclei, hermetically fixed inside the inner casing. It also has several inner casing caps that not only hermetically preserve the nuclei, but also work together as conductors. The function of the magnetic nucleus is to ionize the molecules of the fuels produced by hydrocarbons. The entire fuel economizing and contaminant reduction unit is surrounded and protected by a rigid polyurethane insulation material that both protects the unit from blows and insulates it from excessive temperatures.

The U.S. Pat. No. 4,429,665 describes a unit and a method to improve the combustion characteristics of liquid fuels. The unit comprises an elongated, hollow body, with inlet and outlet points that are fitted in line with the fuel to be treated. The elongated body contains an elongated metal bar that is placed so that the outer surface of the metal bar is in direct contact with the fluid to be treated. The metal bar is triangular in section and is fitted inside the hollow body, and is made of an alloy of 30 to 60% copper, 15 to 40% zinc, 10 to 30% nickel, 5 to 20% tin and 1 to 10% silver.

We can also mention the U.S. Pat. No. 6,306,185 that relates to a fuel catalyzer that improves combustion efficiency. This unit includes at least one hydride element, one element that is more active than the hydride element in electrolytic terms, and one element that is less active than the hydride element in electrolytic terms. The hydride element preferably includes at least one element from Groups IV and V of the periodic table. The preferred formula of the catalytic element includes 20 to 60 weight % antimony, 10 to 30 weight % tin, 10 to 80 weight % zinc and 1 a 5 weight % silver.

There are also numerous other national and foreign documents that describe fuel treatment units that may be used to improve the efficiency of combustion in internal combustion engines, in addition to saving fuel and reducing contaminants. Nevertheless, the problem of some of these units is that they are very expensive, as the alloy of the metal bar comprises precious metals, such as palladium and silver. Likewise, other of the above-described apparatus requires constant maintenance to keep them in optimum operating condition.

In addition to the foregoing, the alloy described in Mexican Patent No. 197033 includes lead as a component thereof, which represents an inconvenience because of the well known polluting and poisoning characteristics of lead, on account of which its use has been restricted.

Therefore, a way has been sought to solve the problems of both internal combustion systems and units used to reduce contaminants found during the combustion process, and to design and develop an apparatus to improve the efficiency of internal combustion, reduce the emission of contaminants and save fuel, thus providing a practical and simple solution to the problem of environmental deterioration, and the inefficiency of units that are currently being used to attempt to solve this problem.

OBJECTS OF THE INVENTION

Having in consideration the disadvantages of equipment that uses the aforementioned process of the prior art, it is an object of the present invention to provide a practical and simple apparatus that improves combustion efficiency in internal combustion systems, and also efficiently reduces exhaust gases when fuel is being burnt, thus reducing the amount of contaminants emitted into the atmosphere.

Another object of the present invention is to provide an apparatus for improving combustion efficiency in internal combustion systems in order to make the mixture more uniform and optimize atomization of the fuel, thus providing a more complete combustion process to achieve maximum efficiency.

It is still another object of the present invention is to provide an apparatus for improving combustion efficiency in internal combustion systems, which permit to reduce fuel that is not burnt or is only partially burnt, thus saving fuel.

A further object of the present invention is to provide an apparatus for improving combustion efficiency in internal combustion systems in order to decrease the temperature of exhaust gas, to thus increase the working life of machines and engines.

Yet another object of the present invention is to provide an apparatus for improving combustion efficiency in internal combustion systems in order to increase performance by reducing the amount of fuel not burnt or partially burnt.

Additional object of the present invention is to provide an apparatus for improving combustion efficiency in internal combustion systems in order to reduce the frequency of and simplify system maintenance, as it has no moving parts or any other part that needs to be replaced.

It is an additional object of the of the present invention to provide an apparatus for improving combustion efficiency in internal combustion systems that permits the ground connection of the apparatus when in use, to thus protect the reaction of the fuel and the metal bar from any interference caused by magnetic fields generated by any electrical supply source.

BRIEF DESCRIPTION OF THE DRAWINGS

The novel aspects that are considered characteristic of the present invention are particularly set forth in the appended claims. The invention itself, however, both as to its organization and its method of operation, together with additional objects and advantages thereof, will best be understood from the following description of a specific embodiment thereof, when read in relation to the appended drawings, in which:

DETAILED DESCRIPTION OF THE INVENTION

When a liquid fuel used in an internal combustion system passes through an elongated hollow chamber, simultaneously entering into direct contact with an elongated metal body made from a special alloy, the fuel is purified, thus making the combustion process more efficient. This reduces the emission of contaminants, thus decreasing maintenance costs of the machine, extending its working life and saving fuel.

Figure 1:
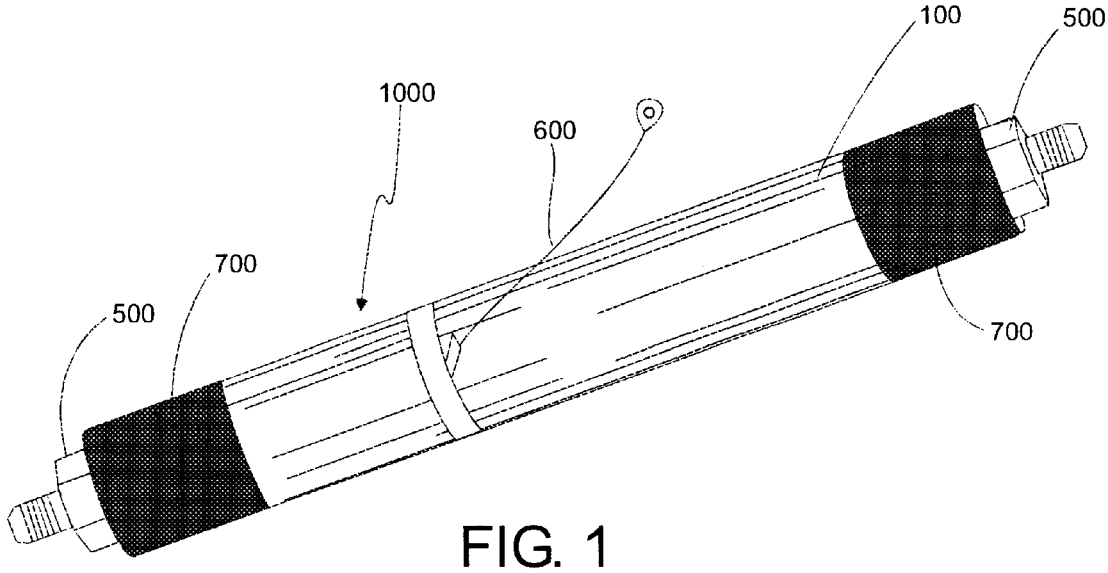
FIG. 1 is a perspective view of an apparatus for improving combustion efficiency in internal combustion engines, which is built in accordance with the principles of a specifically preferred embodiment of the present invention.
Figure 2:
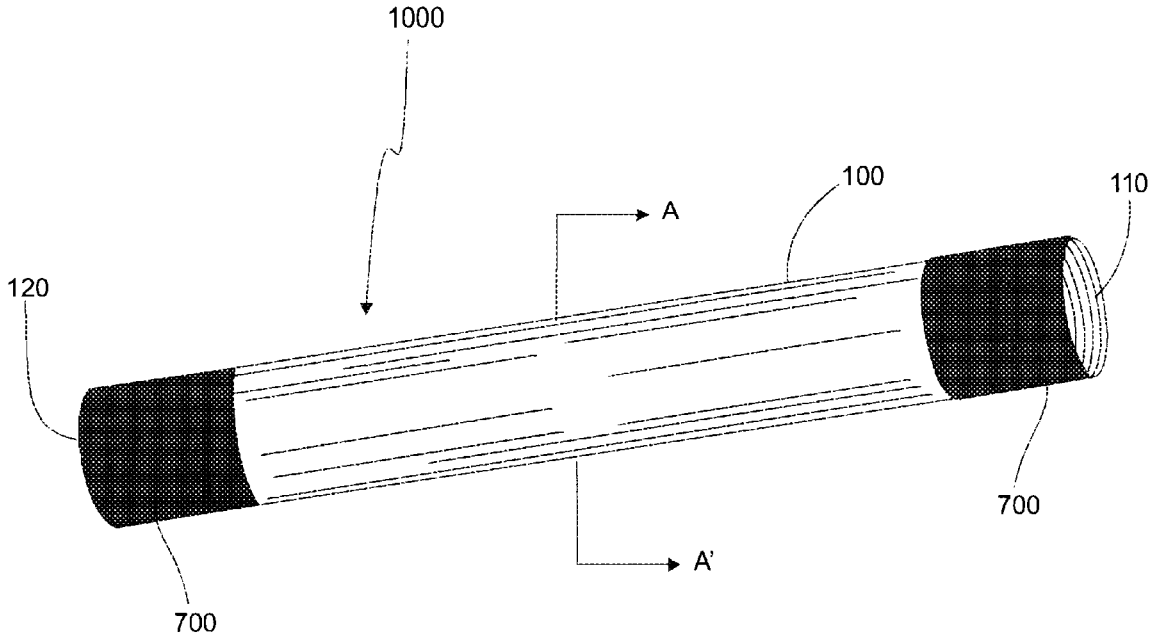
FIG. 2 is a perspective view of the apparatus in FIG. 1, built in accordance with the principles of the specifically preferred embodiment of the present invention, but does not include either the grounding means or the interconnection means.
Figure 3:
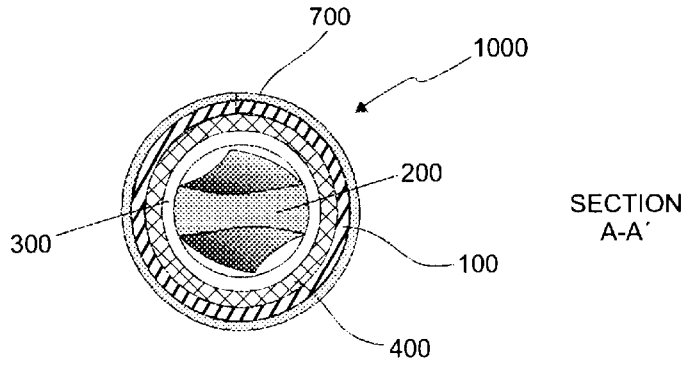
FIG. 3 is a cross-section view of A–A' line of FIG. 2.

With specific reference to FIGS. 1 to 3 of the appended drawings, these show an apparatus (1000) for improving combustion efficiency in internal combustion systems, built in accordance with the principles of a specifically preferred embodiment of this invention, which should be considered as illustrative but not restrictive thereof. This apparatus (1000) may be used in any internal combustion system, preferably in boilers that use waste oil, installed in the fuel line (not shown in figures), more specifically, between the internal combustion system (not shown in figures) and the fuel supply source (not shown in figures).

The apparatus (1000) of the present invention comprising a casing (100) having an inlet (110) and an outlet (120) at its ends for receiving and discharging, respectively, the fuel to be treated; an elongated metal bar (200) concentrically located within said casing (100) between said inlet (110) and said outlet (120) to enter into direct contact with the fuel, said metal bar (200) being made of an alloy comprising, by weight, 30–60% cooper, 10–30% nickel, 15–40% zinc, 5–20% tin and 1–10% silver; a sleeve (300) concentrically situated between the casing (100) and the elongated metal bar (200); separation means (400) concentrically located between the casing (100) and the sleeve (200) to isolate the casing (100) from the sleeve (200); interconnecting means (500) attached to the inlet (110) and the outlet (120) to interconnect the apparatus (1000) with the fuel supply source (not shown in the accompanied drawings) and the internal combustion system (not shown in the accompanied drawings); fixing means (not shown in figures) situated inside each end of the casing (100) to hold the metal bar (200) in place; grounding means (600) located at the outer surface of the casing (100) to ground the apparatus (1000) when in use, to thus protect the reaction of the fuel and the metal bar (200) from any interference caused by magnetic fields generated by any electric supply source; and a plastic film (700) covering each end of the casing (100) for electrically insulating said ends.

The casing (100) of the present invention, which is described in the specific embodiment and shown in FIGS. 1 and 2 of the appended drawings, is of cylindrical and elongated shape, open at each end, wherein these ends constituting the inlet (110) and outlet (120) of the casing (100). Said casing is an electrolytic copper tube.

Figure 5:
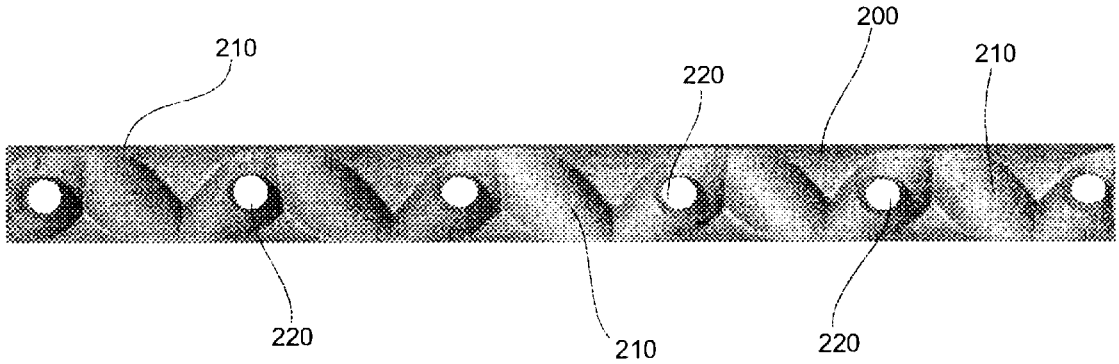
FIG. 5 is a top view of an elongated metal bar, built in accordance with the principles of the specifically preferred embodiment of the present invention.
Figure 6:
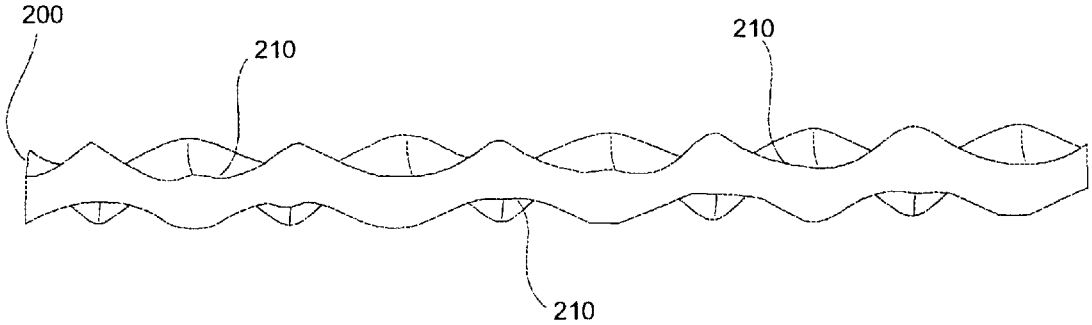
FIG. 6 is a front elevation view of the elongated metal bar that appears in FIG. 4.

The elongated metal bar (200) of the present invention, which is described in the specific embodiment and shown in FIGS. 3, 5 and 6 of the appended drawings, has a plurality of cuts (210) having a concave shape and arranged diagonally along the entire surface of the upper and lower face of the metal bar (200), and a plurality of holes (220) that run from side to side across the section of the metal bar (200), placed and distributed at an equal distance lengthwise to provide the metal bar with a larger contact area, so that the fuel when passes through the apparatus (1000) of the present invention has greater contact with the metal bar (200), to thus the metal bar (200) may fulfill its function, which is rearranging the molecules of the fuel's hydrocarbon chain.

In accordance with the foregoing, the specific function of the metal bar (200) is to stimulate the molecular rearrangement of the fuel's hydrocarbon chain and creating a swirling action in order to produce an electrostatic charge, so that the polarization effect of the fuel improves atomization of the fuel, to thus providing a more complete and efficient combustion process, reducing exhaust gases and saving fuel, all this making combustion more efficient.

The special alloy of the elongated bar (200) additionally comprises an amount of from about 0.05 to 1% by weight of manganese.

In a preferred embodiment of the present invention, the special alloy of the elongated metal bar (200) comprises, by weight, 40–70% copper; 24–40% zinc; 15–32% nickel; 2–8% tin; 0.05–0.99% silver; and 0.05–1.0% manganese.

Preferably, the special alloy of the metal bar (200) comprises, by weight, 45% copper, 25% zinc, 20% nickel, 5% tin, 0.05% silver and 0.05% manganese.

Figure 4:
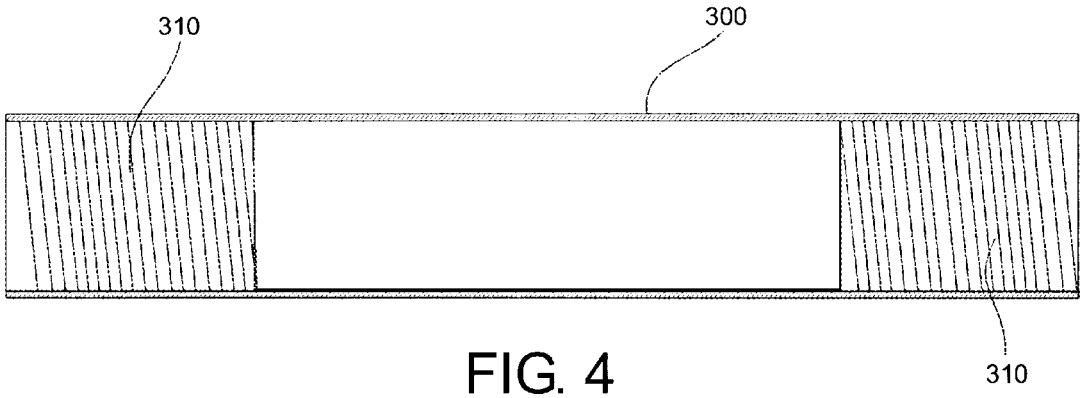
FIG. 4 is a cross-section view of a sleeve that functions as chamber built in accordance with the principles of the specifically preferred embodiment of the present invention.

The sleeve (300) of the present invention, which is described in the specific embodiment and shown in FIGS. 2 to 4 of the appended drawings, is of a cylindrical and elongated shape, open at each end, wherein said sleeve (300) preferably is an electrolytic copper tube of approximately the same length as that of the casing (100). The sleeve (300) also includes at each of its ends an inner female screw thread (310).

The separation means (400) are of a cylindrical and elongated shape, open at both ends and having approximately the same length of the casing (100), said separation means (400) being inserted under pressure into the casing (100) so that the sleeve (300) does not rotate in said casing (100). The separation means (400) are made of an insulating plastic material.

Figure 7:
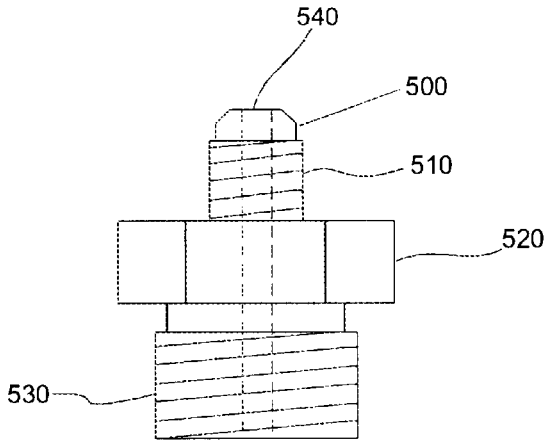
FIG. 7 is a front elevation view of the interconnection means, built in accordance with the principles of the specifically preferred embodiment of this invention.

The interconnecting means (500) of the present invention, which are described in the specific embodiment and shown in FIGS. 1 and 7 of the appended drawings, comprise a first outer section (510) of a cylindrical shape, a second middle section (520) of an hexagonal shape and a third inner section (530) of a cylindrical shape; the diameter of the third inner section (530) being twice the diameter of the first outer section (510). The interconnecting means (500) also including a hole (540) for passage of the fuel, said hole (540) being concentrically positioned so that the central longitudinal axis of the hole (540) is in line with the central longitudinal axis of said interconnecting means (500) and crosses from side to side lengthwise of said interconnecting means (500) to permit the fuel passes through said hole (540).

The third inner section (530) has a male screw thread for connecting to the female screw thread (310) of each end of the sleeve (300), so that the interconnecting means (500) may be coupled to the apparatus (1000), hermetically sealing the inlet (110) and the outlet (120) of the casing (100) to prevent fuel leaking. The interconnection means (500) are strongly tightened using any tightening or tool implement inserted at the second middle section (520).

The interconnecting means (500) are made from a metallic material, preferably are made of steel, to which an electrolytic coating is applied to prevent corrosion of said interconnecting means (500).

The fixing means (not shown in figures) to which the specific embodiment of the apparatus (1000) of the present invention relates, comprise two springs, one of which is situated at the inlet end of the apparatus (1000) and the other one at the outlet end, specifically between the interconnecting means (500) and the elongated metal bar (200).

The grounding means (600) of the present invention, which are described in the specific embodiment and shown in FIG. 1 of the appended drawings, comprise a ring that surrounds said casing (100) and includes a male terminal into which a female terminal attached to an electric cable is inserted, the other end of the cable being connected to any metal part of the internal combustion system.

The apparatus of the present invention will be best understood with reference to the following examples, which should be considered as illustrative and not limitative thereof:

EXAMPLE I

The process for obtaining the alloy of the elongated metal bar was the following:

a) The following materials were weigh:

| | |
|---|---|
| Copper | 50 lb (22.7 Kg) |
| Zinc | 25 lb (11.35 Kg) |
| Tin | 10 lb (4.54 Kg) |
| Nickel | 20 lb (9.08 Kg) |
| Silver | 0.5 lb (0.227 Kg) |
| Manganese | 0.5 lb (0.227 Kg) |

b) Secondly, the copper, zinc, tin, silver and manganese metals were introduced into a graphite crucible and heated using a furnace to form a molten mass. The crucible was heated in the range of from about 1800° to about 2200° F. (980°–1200° C.) and the nickel metal was added the to molten mass. After the metals have all reached the liquid state, the crucible was further heated in the range of from about 2600° to about 2800° F. (1425°–1540° C.).

c) The temperature is maintained a sufficient time of at least 5 minutes, in which time a little quantity of borax is added in order to rescue the impurities and eliminating the metallic oxides.

d) After this, the crucible was removed from the furnace and the molten mass contained therein was poured into a rectangular-shape mold and allowed to solidify into said mold.

e) Once the elongated bar was cooled, a plurality of cuts were made over its upper and lower faces, in order to have a greater surface contact between both the elongated metal bar and fluid to be treated.

The elongated metal bar thereafter introduced into a cylindrical housing having a fluid inlet and a fluid outlet at opposite ends thereof, and the fluid treatment apparatus thus obtained was installed in the fluid conduit of a kettle.

EXAMPLE II

The apparatus described in the above example I, was installed in the fluid conduit of a kettle "TAM Stadler Maribor" type ZV, specifically installed just before of a burner with a warm effect of 324–570 Kw and having a consumption of 30–50 Kg/h oil. The kettle was installed in a heating room, in order that the contaminant emissions could be measured.

The combustible used was waste oil while was poorered out from main tank into day tank was first filtered using a loop filter. In day tank oil is pre-heated on pre-heating temperature. Together with the filters pumps were installed and with them oil is pressure is rising to approximate 20 bar, and oil is continuing to be filtered with magnetic filters and it was being heated on temperature of 120° C. Such oil before going into burner passes the apparatus of the present invention in which was ionized.

The chimney, to which the kettle was connected, had 8 m high and 0.4 m diameter, the conexion from the kettle to the chimney was carried out using a chimney line diameter of 0.3 m.

Points of Measurements

On the apparatus, which broadcast gas, steam, aerosol and stiff particles.

The door for test prove of plant of heating room, located on straight part of the chimney line at a determined distance relating to the diameter of the chimney in place of the circulation of smoke gas.

The door on the apparatus, which were controlled, were clearly marked and recognized for occasional measurements, they were adjusted to prove.

Plant Conditions

Nitric oxide ($NO_3$): Emission of nitric oxide was the highest during maximum load on apparatus and measurement must be done on mentioned load.

Carbon monoxide (CO): Emission of Co was the highest during maximum load of apparatus of these working conditions.

Smoke number: Degree of black surface filter paper caused with smoke gas must be measured within total work of burner.

Stiff particle: Concentration of stiff particles and inorganic substances must be measured within total work of burner operations.

Anorganic combines: Concentration of anorganic combines and inorganic substances must be measured with total work of burner.

Measurement Devices

Universal electronic analyzer of smoke gas "Dr äger—MSI 150" No. 9810004.

Device for gravimetric taking of the samples stiff particles in smoke gas, which has vacuum pump "Gast, model 72R655—V10—C222TX" No. 001200162, flow measurement, dry gas measurement "Ikom, Rombach" No. 4273821, and head with filters for taking the samples of stiff particles.

Device for determination of smoke No. By Bacharach method.

Instrument for measurement of harmful gases and steam in working area "CMS Analyzer".

Measurement of speed from air circulation "Testovent 4000" No. 602.

Results of Measurements

Results of measurements were stable below and they were compared with Emission Limit Values (GVE) from Article 77 (medium device for heating which uses special liquid fuel) and Article 79 (big devices, which use liquid fuel) on limit values of emission pollution substances into air.

Values mass concentration pollution substances obtained from measurements were according to volume part of oxygen and waste gas and they were calculated according to Article 6.

CHART I

| KETTLE WITH BURNER ON WASTE OIL | DIMEN-SIÓN | MEASURED AMOUNT | GVE** |
|---|---|---|---|
| Smoke No. | — | 1 | 1 |
| $CO_2$ | % | 9.7 | 10 |
| Heat loss in waste gas | % vol. | 10.5 | — |
| CO* | $mg/m^3$ | 3 | 170 |
| $NO_2$* | $mg/m^3$ | 294 | 350 |
| $SO_2$* | $mg/m^3$ | 749 | 1700 |
| HCL* | $mg/m^3$ | 1.24 | 30 |
| HF* | $mg/m^3$ | 0.43 | 5 |
| Mass part stiff particles* | $mg/m^3$ | 76.4 | 50 |
| Inorganic substances (As, Pb, Cd, Cr, Co)* | $mg/m^3$ | 0.136 | 2 |
| Inflected volume part oxygen | % vol. | 3 | 3 |
| Excess volume part oxygen | % vol. | 6.7 | |
| Temperature of air in heating room | ° C. | 24 | |
| Temperature of smoke gas | ° C. | 219 | |
| Atmospheric pressure | kPa | 101.7 | |
| Dynamic pressure in chimney line | Pa | 20 | |
| Circulation speed of smoke gas in chimney | M/s | 5.71 | |
| Area of intersection chimney line | $m^2$ | 0.0707 | |
| Volume flow smoke gas | $m^3/h$ | 1453.31 | |
| Mass flow of CO | g/h | 4.36 | |
| Mass flow of $NO_2$ | g/h | 427.27 | |
| Mass flow of $SO_2$ | g/h | 1088.53 | |
| Mass flow of HCl | g/h | 1.80 | |
| Mass flow of HF | g/h | 0.62 | |
| Mass flow of stiff particles | g/h | 140.10 | |
| Mass flow of inorganic substances (As, Pb, Cd, Cr, Co) | g/h | 0.20 | |

*According to Article 77 and 79 and GVE set in chart are mass concentration of polluting substances in dry waste gas temperature 273° K. and pressure 101.3 kPa.

According to Article 74 special liquid fuel (waste oil) may be used only in medium and big heating device.

Article 74—Resolution of limiting quantities of emission of polluting substances into air from stationary sources ("Narodine novine" No. 140/97) does not suspect the use of special liquid fuels (waste motor oil) in small devices on liquid fuel (0.1–5 MW) so the results of measurements on mentioned stationary device with GVE from Article 77 of resolution (medium devices which use special liquid fuels).

Conclusion and Opinion

Measurement of emission was carried out on small device for heating (kettle) obtained results show that by using appropriate technology preparation of the waste oil before combustion, may be achieved parameters of combustion (emission) pre-described for small to big burner devices.

Measured values of emission show that burning of waste oil in small burning device in a way shown in functional block-scheme does not cause the emission of polluting substances into air higher than the emission in medium size burned devices except the emissions of $NO_2$ and thermal losses in waste gasses.

The emission of $NO_2$ and thermal losses in waste gas were in direct connection to the temperature of burning in burner that depends specifically on constructions and purpose of the kettle.

The measurement of emissions was done in a small burning device (kettle) and results show that with the proper technology of the preparation of waste oil before there could be achieved the parameters of burning (emission) set for the medium burning devices.

In accordance with that previously described and as illustrated in the attached drawings, it may be seen that the apparatus used to improve combustion efficiency in internal combustion systems has been calibrated to provide a uniform mixture and optimize atomization of the fuel, to thus practically and simply produce a more complete combustion process and achieve maximum efficiency. The apparatus may be installed quickly in the internal combustion system, so it will be obvious to any expert in this area that the embodiments described previously are only illustrative and not limit the invention, as there are numerous modifications that may be made, such as the interconnection means, the weight percentage of the alloy materials of the metal bar, and others, without this altering the essential scope and function of the invention.

Even though a specific embodiment of this invention has been described and illustrated, we should emphasize that there are numerous modifications that may be made. Therefore, this invention should not be considered as restrictive, except for that which the prior art requires, and for the attached claims.

What is claimed is:

1. An apparatus for improving the combustion efficiency in internal combustion systems comprising a casing having an inlet and an outlet at its ends for receiving and discharging, respectively, the fuel to be treated;

an elongated metal bar concentrically located within said casing between said inlet and said outlet so as to enter into direct contact with the fuel, said metal bar being made of an alloy comprising, by weight, 40–70% copper, 10–32% nickel, 15–40% zinc, 2–20% tin and 0.05–10% silver;

a sleeve concentrically located between said casing and said elongated metal bar;

separation means concentrically situated between said casing and said sleeve, to isolate said casing from said sleeve;

interconnecting means attached to said inlet and said outlet, to interconnect the apparatus with the fuel supply and the internal combustion system;

fixing means situated inside of each end of the casing, to hold the metal bar in place;

grounding means located at the outer surface of the casing, to ground the apparatus when in use, to thus protect the reaction of the fuel and the metal bar from any interference caused by magnetic fields generated by any electric supply source; and, a plastic film externally covering each end of said casing for electrically insulating said ends, wherein said elongated metal bar comprises a plurality of cuts having a concave shape and arranged diagonally along the entire surface of the upper and lower face of the metal bar, and a plurality of holes that run from side to side across the section of the metal bar, placed and distributed at an equal distance lengthwise.

2. The apparatus for improving the combustion efficiency in internal combustion systems, according to claim 1, wherein said separation means are of a cylindrical and elongated shape, open at both ends, said separation means being inserted under pressure into the casing so that the sleeve does not rotate in the casing.

3. The apparatus for improving combustion efficiency in internal combustion systems, according to claim 2, wherein said separation means are made of an insulating plastic material.

4. The apparatus for improving combustion efficiency in internal combustion systems, according to claim 1, wherein said interconnecting means comprise a first outer section of a cylindrical shape, a second middle section of an hexagonal shape and a third inner section of a cylindrical shape; the diameter of the third inner section being twice the diameter of the first outer section; said interconnecting means also include a hole for passage of the fuel, said hole being concentrically positioned so that the central longitudinal axis of the hole is in line with the central longitudinal axis of said interconnecting means and crosses from side to side lengthwise of said interconnecting means.

5. The apparatus for improving combustion efficiency in internal combustion systems, according to claim 4, wherein said first outer section of the interconnecting means has an external male screw thread so that it may be interconnected either to the supply source or to the internal combustion system, depending on whether the connector is at the inlet or at the outlet point of the casing.

6. The apparatus for improving combustion efficiency in internal combustion systems, according to claim 4, wherein said third inner section of the interconnecting means has a male screw thread for connecting to the female screw thread of each end of said sleeve, so that the interconnecting means may be coupled to the apparatus, hermetically sealing the inlet and the outlet of said casing to prevent fuel leaking.

7. The apparatus for improving combustion efficiency in internal combustion systems, according to claim 4, wherein said interconnecting means are made of steel, to which an electrolytic coating is applied to prevent corrosion of said interconnecting means.

8. The apparatus for improving combustion efficiency in internal combustion systems, according to claim 1, wherein said fixing means comprise two springs, one of which is situated at the inlet end and the other one at the outlet end, between said interconnecting means and said elongated metal bar.

9. The apparatus for improving combustion efficiency in internal combustion systems, according to claim 1, wherein said interconnecting means comprise a ring that surrounds said casing and includes a male terminal into which a female terminal attached to an electric cable is inserted, the other end of the cable being connected to any metal part of the internal combustion system.

10. The apparatus for improving the combustion efficiency in internal combustion systems, comprising a casing having an inlet and an outlet at its ends for receiving and discharging, respectively, the fuel to be treated;

an elongated metal bar concentrically located within said casing between said inlet and wherein said alloy comprises an amount of 40–70% copper, 15 to 32% nickel, 24–40% zinc, 2–8% tin and 0.05–0.99% silver;

a sleeve concentrically located between said casing and said elongated metal bar;

separation means concentrically situated between said casing and said sleeve, to isolate said casing from said sleeve;

interconnecting means attached to said inlet and said outlet, to interconnect the apparatus with the fuel supply and the internal combustion system;

fixing means situated inside of each end of the casing, to hold the metal bar in place;

grounding means located at the outer surface of the casing, to ground the apparatus when in use, to thus protect the reaction of the fuel and the metal bar from any interference caused by magnetic fields generated by any electric supply source; and, a plastic film externally covering each end of said casing for electrically insulating said ends wherein said elongated metal bar alloy comprises a plurality of cuts having a concave shape and arranged diagonally along the entire surface of the upper and lower face of the metal bar, and a plurality of holes that run from side to side across the section of the metal bar, placed and distributed at an equal distance lengthwise, and wherein said metal bar additionally comprises 0.05–1.0% by weight of manganese.

11. The apparatus for improving the combustion efficiency in internal combustion systems, according to claim 10, wherein said special alloy comprises, by weight, 30–60% copper; 15–40% zinc; 15 to 30% nickel; 2 to 8% tin; 0.05 to 0.99% silver and 0.05 to 1% manganese.

12. The apparatus for improving combustion efficiency in internal combustion systems, according to claim 11, wherein said special alloy comprises, by weight, 45% copper, 25% zinc, 20% nickel, 5% tin, 0.05% silver and 0.05% manganese.

13. An apparatus for improving combustion efficiency in internal combustion systems, comprising a casing having an inlet and an outlet at its ends for receiving and discharging, respectively, the fuel to be treated;

an elongated metal bar concentrically located within said casing between said inlet and said outlet so as to enter into direct contact with the fuel, said metal bar being made of an alloy comprising, by weight, 40–70% copper, 10–32% nickel, 15–40% zinc, 2–20% tin and 0.05–10% silver;

a sleeve concentrically located between said casing and said elongated metal bar;

separation means concentrically situated between said casing and said sleeve, to isolate said casing from said sleeve;

interconnecting means attached to said inlet and said outlet, to interconnect the apparatus with the fuel supply and the internal combustion system;

fixing means situated inside of each end of the casing, to hold the metal bar in place;

grounding means located at the outer surface of the casing, to ground the apparatus when in use, to thus protect the reaction of the fuel and the metal bar from any interference caused by magnetic fields generated by any electric supply source; and, plastic film externally covering each end of said casing for electrically insulating said ends, wherein said sleeve is of a cylindrical and elongated shape, open at each end, each end of the sleeve having an inner female screw thread.

14. The apparatus for improving the combustion efficiency in internal combustion systems, according to claim 13, wherein said sleeve is an electrolytic copper tube.

* * * * *